US005372260A

United States Patent [19]

Jäger

[11] Patent Number: 5,372,260

[45] Date of Patent: Dec. 13, 1994

[54] SCROLL-CONVEYOR CENTRIFUGE WITH TEXTURED INTERIOR BOWL SURFACE

[75] Inventor: Ernst A. Jäger, Vilsbiburg, Germany

[73] Assignee: Flottweg GmbH, Vilsbiburg, Germany

[21] Appl. No.: 983,081

[22] Filed: Nov. 27, 1992

[30] Foreign Application Priority Data

Nov. 26, 1991 [DE] Germany ..... 4138855

[51] Int. Cl.[5] ..... B07B 13/00

[52] U.S. Cl. ..... 209/49; 209/157; 209/724; 209/725

[58] Field of Search ..... 209/45, 49, 157, 208, 209/211, 724, 725; 210/781, 784, 787, 788, 789, 512.1, 512.3

[56] References Cited

U.S. PATENT DOCUMENTS 2,101,572 12/1937 Broatch ..... 209/49
2,806,599 9/1957 Patrick ..... 209/211

FOREIGN PATENT DOCUMENTS 0076476 4/1983 European Pat. Off. ..... B04B 1/20
2257884 9/1973 Germany .
2746877 4/1979 Germany ..... B04B 7/12
3503896 8/1986 Germany ..... B01F 15/00

*Primary Examiner*—David H. Bollinger
*Attorney, Agent, or Firm*—Alfred Stapler

[57] ABSTRACT

A scroll-conveyor centrifuge for separating a suspension into at least a liquid phase and solid material which is deposited through centrifugal force on the interior surface of the centrifuge bowl and which is conveyed along that surface to the solid material discharge opening located at an axial end portion of the bowl through rotation of the centrifuge helix at a differential rate with respect to the bowl. Abrasion of the interior bowl surface and operating power requirements due to movement of the solid material in the direction of the bowl circumference are both reduced by the simple expedient of applying to the interior bowl surface a texturing through the spray application of a thin adhering layer having a rough surface facing the helix.

18 Claims, 4 Drawing Sheets

SCROLL-CONVEYOR CENTRIFUGE WITH TEXTURED INTERIOR BOWL SURFACE

BACKGROUND OF THE INVENTION

The invention relates to a scroll-conveyor centrifuge for separating a suspension into at least a liquid phase and solid material which deposits, through centrifugal force, on the interior bowl surface facing the helix or scroll and which is conveyed along that inner surface of the bowl to the solid material outlet located in one axial end portion of the bowl by means of the helix rotating at a relatively small differential rate with respect to the bowl, said end portion of the bowl being of conically-diminishing dimension, and the inner surface of the bowl being provided with a texturing which impedes movement of the solid material in a direction circumferential to the bowl.

The solid material which deposits due to the centrifugal force on the interior surface of the bowl during operation of the centrifuge is to be conveyed by the helix to the solid material discharge openings in the casing by the shortest possible path, especially in order to keep down friction and wear. Due to the differential movement between helix and bowl, the solid material appearing between the interior bowl surface and the helix has the tendency to be conveyed along the interior surface of the bowl with a movement component having a circumferential orientation, thereby defining a generally spiral-shaped path leading to the solid material discharge openings. To prevent this, and to convey the solid material as much as possible in the axial direction of the centrifuge bowl, one has previously provided the interior surface of the bowl with grooves, or ridges, or attached lands in order to enhance the reluctance of the solid material to move in the circumferential direction of the bowl on its interior surface. The frictional wear on the helix is counteracted by armoring the outer portions of the helix turns, e.g. by coating them with ceramic powder, tungsten carbide, or the like, the coating surface being made smooth after application, in order to keep the frictional resistance of the solid material at the helix turns as low as possible. Such armor coatings have also been provided in the area of the above-mentioned groove or ridge formations on the interior surface of the bowl. By so shaping the inner surface of the casing in its axial direction, one has previously endeavored to form a protective sedimentary layer intended to counteract the wear and tear on the highly stressed interior surface of the casing bowl caused by displacement of the solid material by the helix.

The forming of grooves, ridges, or lands upon the interior wall of the bowl demands rather costly processing.

SUMMARY OF THE INVENTION

The invention has as its object to simplify, as much as possible, the treatment of the interior bowl surface so as to avert the enhancement in wear and tear and the increase in operating power requirements which result from solid material movement in the circumferential direction of the bowl.

Given a centrifuge with the initially-described characteristics, this object is achieved in accordance with the invention by providing the surface texturing by means of an adhering layer which is thinly sprayed on to the interior bowl surface and which has a rough surface facing the helix.

The application of such an adhering layer has the surprising result that the solid material is conveyed mainly in an axial direction-and thus along the shortest path-to the solid material discharge opening. For that reason alone, the operating power requirements are reduced and the interior bowl surface is protected from wear. The roughness of the adhering layer surface facing the helix retains a sediment layer between itself and the radially outward edge of the helix turns, and this also acts to protect from wear. A special advantage of this treatment of the interior bowl surface so as to oppose circumferential movements of the solid material is that it requires merely the spraying-on of a thin, continuous adhering layer during the manufacturing process. Such spraying-on avoids having to treat the bowl casing by machining or molding and can, in itself, be carried out without difficulty and with the appropriate uniformity. The adhering layer requires no treatment at all of the interior bowl surface itself in order for it to be affixed to that surface without slippage and with the necessary firmness.

In a preferred embodiment, the adhering layer extends completely around the interior bowl surface, providing a continuous covering of the whole surface. In another preferred embodiment, the adhering layer can be confined to partial areas, i.e. it can be formed so as to cover only parts of that surface. In so doing, one can proceed by forming the adhering layer in the shape of strips spaced from each other in the circumferential direction of the bowl. These strips, in turn, can have different configurations. Thus, in one preferred embodiment, they can each be parallel to the rotational axis of the bowl, or else they can be slightly inclined thereto, following the direction of conveyance of the solid material to the solid material discharge opening. The strip-like adhering layer can also extend in screw or spiral form and, indeed, with any desired pitch other than that of the helix turns. Thus, the strip pattern can be oriented in the same sense as the helix turns, clockwise or counterclockwise to match the respectively utilized helix, or in such manner that the screw-shaped or spiral-shaped strip pattern of the adhering layer runs counter to the pitch sense of the turns of the helix with which it is utilized.

Further, it is possible to confine the adhering layer to certain areas so as to form a kind of patchy pattern. This pattern does not have to be uniform. It is further possible to provide a kind of crossing pattern which, in its simplest form, uses strip-shaped adhering layer portions which intersect each other.

Finally, in a preferred embodiment, the adhering layer extends all the way to the solid material discharge opening, and that is the case for essentially every selected layer pattern.

The adhering layer itself can be relatively thin, specifically, less than 0.5 mm in the radial direction.

The adhering layer can be provided by synthetic plastic, ceramic, tungsten carbide, natural and/or synthetic granular materials, as well as mixtures of these materials. In particular, granular materials can be embedded in binders, as is known for grinding tools, particularly grinding discs. It is only necessary that these materials, or mixtures, be capable of being applied by spraying. Subsequent hardening can take place as a function of time and/or temperature. The rough surface facing the separating space is created inherently by the spray application of the adhering layer and, therefore, needs no after-treatment following such application.

Preferred embodiments of the invention are defined in the dependent claims.

BRIEF DESCRIPTION OF THE DRAWINGS

The invention is further described by reference to the exemplary embodiments illustrated in the drawings, in which.

DETAILED DESCRIPTION OF THE PREFERRED EMBODIMENTS

Figure 1:
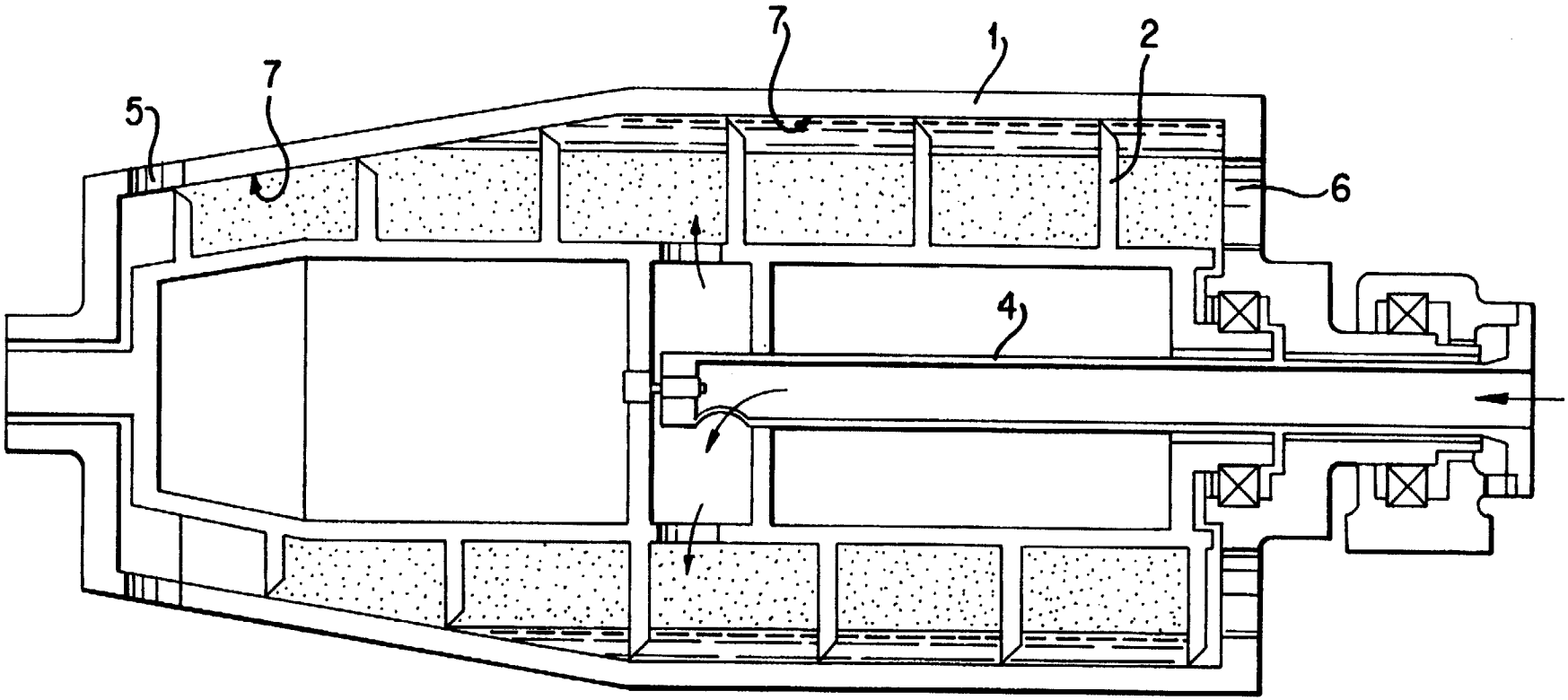
FIG. 1 shows a diagrammatic longitudinal cross-section of a fully-encased scroll-conveyor centrifuge embodying the invention.

The scroll-conveyor centrifuge illustrated in the drawings is basically of conventional construction in that it includes a bowl 1 and a helix 2 which is positioned coaxially within the bowl, which rotates at a differential rate of rotation with respect to the bowl, and whose radially-outward peripheral turn regions extend close to the interior bowl surface. As a result, a suspension which is introduced in the direction of the arrows via inlet pipe 4 into space 3 defined by bowl 1 and helix 2, separates into a liquid phase and a solid phase due to centrifugal force in response to rotation of the bowl at a high rate. The liquid flows out through overflow port 6 at one axial end of the bowl, whereas the solid material which deposits under the effect of centrifugal force at the interior bowl surface, is conveyed by the turns of helix 2 to solid material discharge openings 5 at the opposite axial end of the bowl. This takes place in such manner that the solid material slidingly engages the spiral turns of the helix and the interior wall surface of the bowl. In order to keep the path of the solid material short, i.e., as much as possible in the axial direction of the bowl and free of circumferential components, the interior bowl surface is provided with adhering layer 7 which is sprayed thinly upon the interior bowl surface so as to form a continuous covering layer. The adhering layer, which may consist of a granular, hard material embedded within a plastic binder and which exhibits a rough surface facing the helix, offers sufficiently high frictional resistance to the circumferential movement of the solid material so that the smooth-surfaced helix instead conveys the solid material mainly in an axial direction. In this way, the centrifuge operating power and the wear on the centrifuge components are both kept low.

Figure 2:
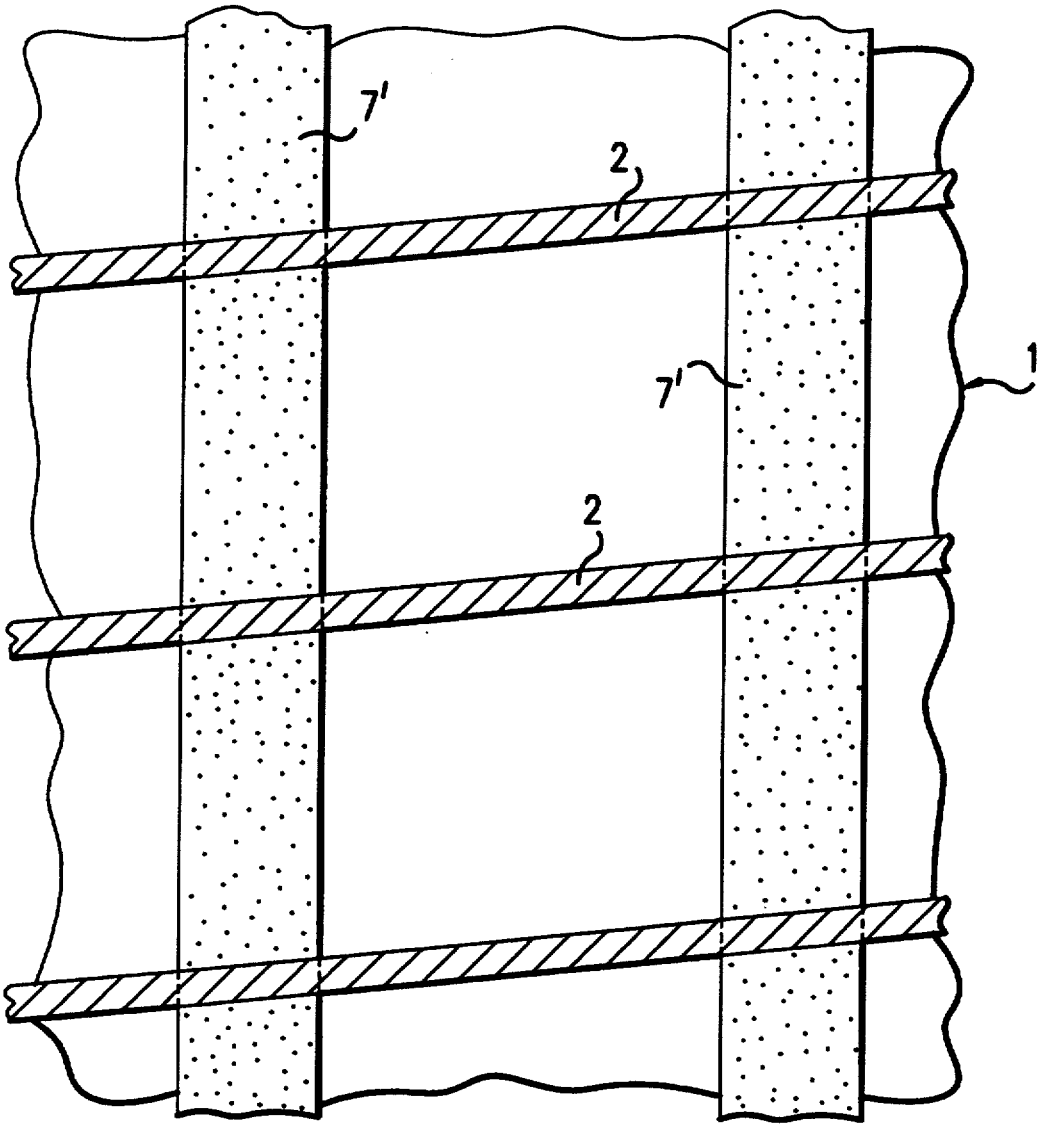
FIGS. 2 through 4 show flattened plan views of portions of various embodiments of adhering layers having different strip shapes on the interior bowl surface, together with the adjoining peripheral regions of the centrifuge helix.

The interior bowl surface portion which is visible in the cross-section of FIG. 1 shows that the adhering layer 7 extends over the whole interior surface of the bowl in the circumferential direction, and also covers that surface continuously up to the solid material discharge opening. In FIG. 2 the adhering layer 7' is subdivided into a plurality, e.g. six, segments, each about 50 mm wide. Accordingly, adhering layer material is sprayed onto the interior bowl surface only in this strip shape with suitable spacings and rotational symmetry. These strips 7' extend parallel to the bowl axis; in a somewhat different embodiment they can be slightly inclined to this axial direction, and specifically so as to conform to the actual path which is followed by the solid material which is conveyed by the turns of the helix to the solid material discharge opening.

Figure 3:
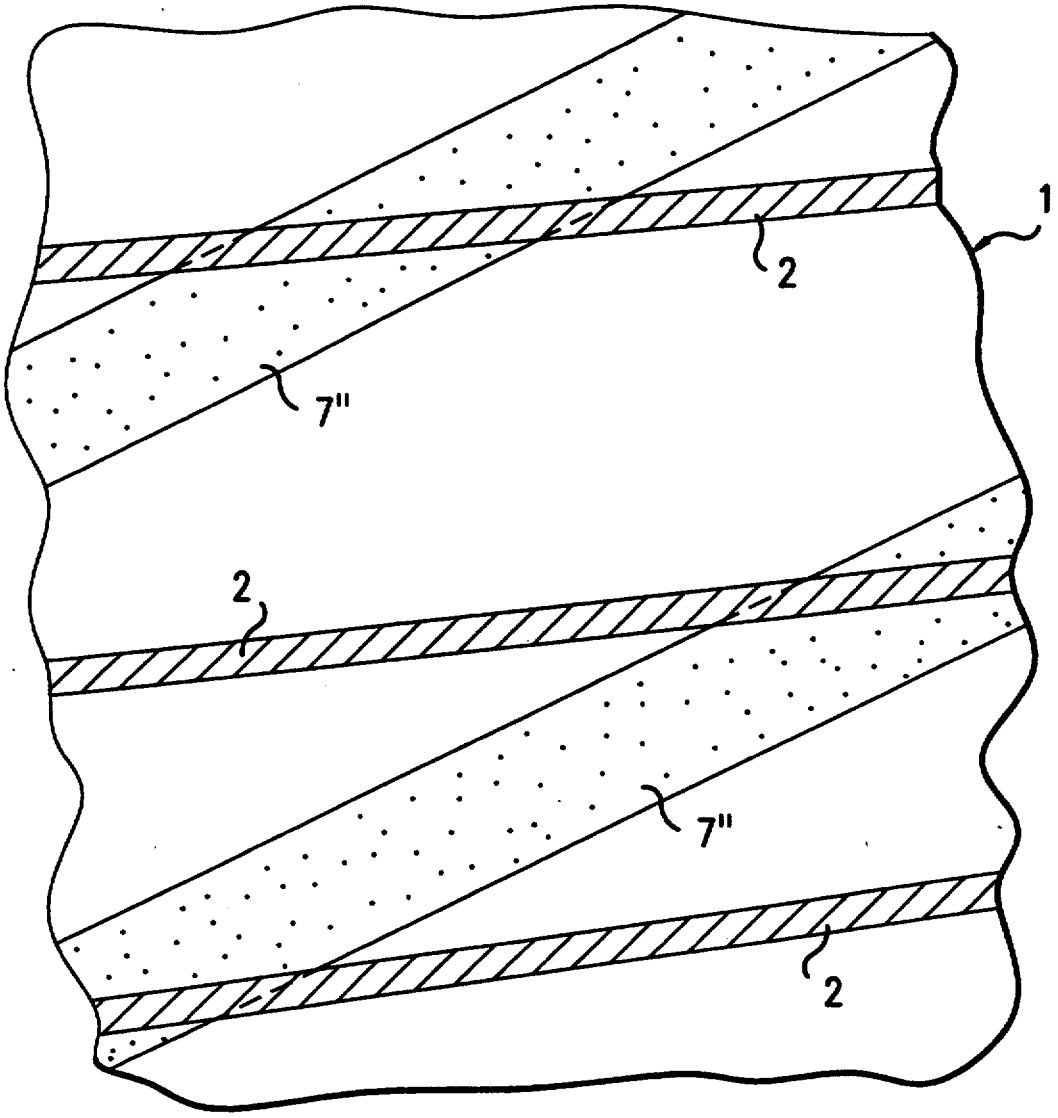

FIG. 3 shows an adhering layer 7'' on the interior bowl surface which is formed as a spirally-extending strip. There can be provided several such spirals which are interleaved in the axial direction. The sense of rotation of the strip-like spiral according to FIG. 3 is the same as that of the helix turns, but with a pitch which is different from that of the helix turns, so that there results a cross-over movement between the outer periphery of the helix spiral and the strip-like layer. The specific dimensioning can be varied within wide limits.

Figure 4:
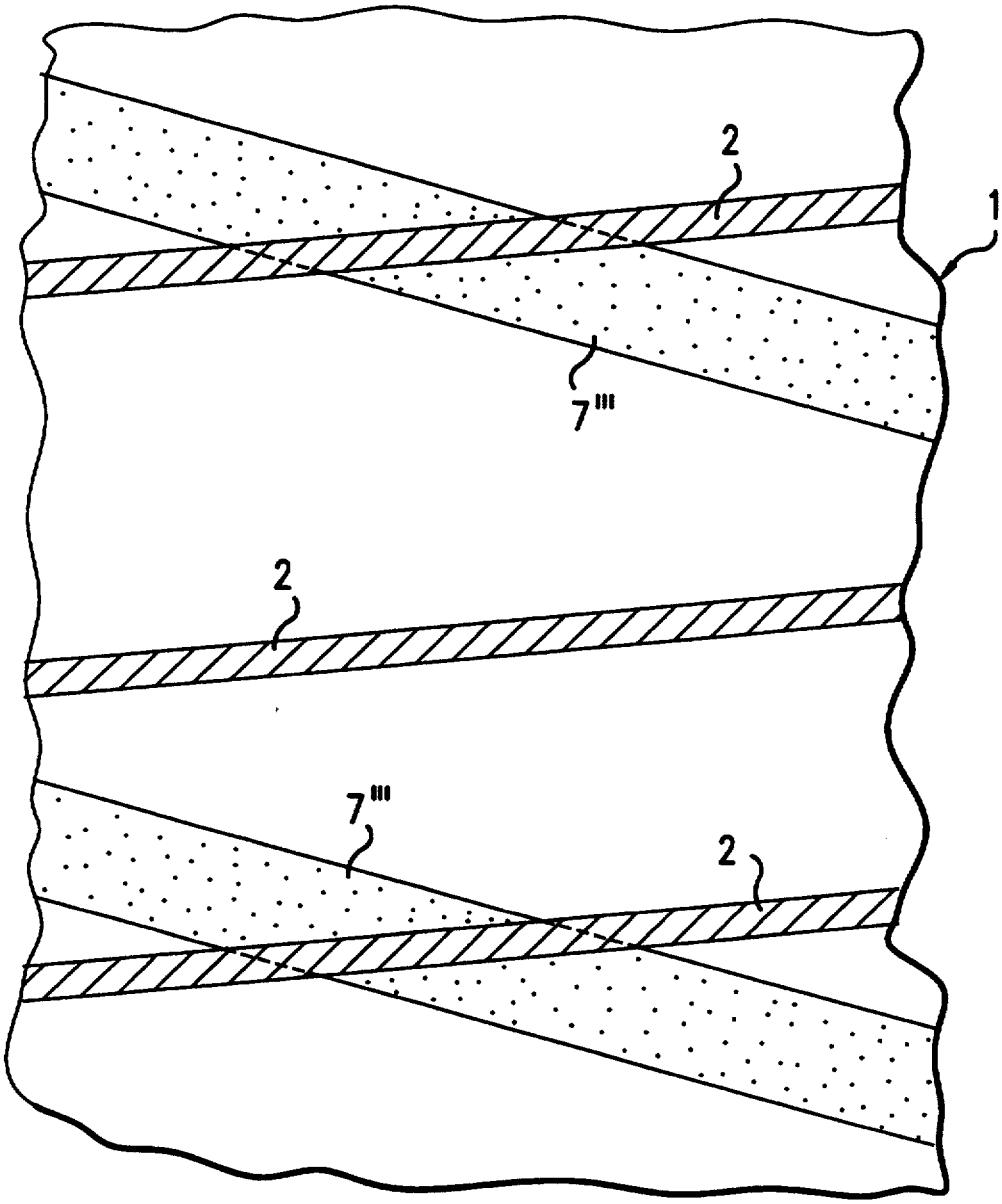

FIG. 4 shows an adhering layer 7''' in the form of a spiral strip whose sense of rotation is opposite to that of the helix turns, so that a crossing of the helix turns over the spiral strip inevitably occurs. Here, too, a plurality of spiral paths of the strip-like adhering layers can, of course, be interleaved in a manner similar to a multi-turn spiral.

What is claimed is:

1. A scroll-conveyor centrifuge comprising a rotatable bowl and a helix rotatable within said bowl for separating a suspension into at least a liquid phase and solid material which is deposited through centrifugal force on the interior surface of the bowl facing the helix and which is conveyed along the interior surface of the bowl to a solid material discharge opening located in a conically narrowing axial end portion of the bowl by rotation of the helix at a relatively small differential rate with respect to the bowl, the interior surface of the bowl being provided with a texturing which impedes movement of the solid material in the direction of the circumference of the bowl, characterized in that the surface texturing is formed by an adhering layer which is sprayed thinly onto the interior bowl surface, which has a rough surface facing the helix, and which is applied to the interior bowl surface in partial areas, so as to convey the solid material mainly in axial direction along the shortest path to the discharge opening.

2. The centrifuge according to claim 1, characterized in that the adhering layer takes the shape of strips spaced apart in the circumferential bowl direction.

3. The centrifuge according to claim 2, characterized in that the strips extend parallel to the axis of rotation of the bowl.

4. The centrifuge according to claim 2, characterized in that the strips extend in the axial direction of the bowl in screw-like shape about its rotational axis and in the same sense as the turns of the helix, but with different pitch.

5. The centrifuge according to claim 2, characterized in that the strips extend in the axial direction of the bowl in screw-like shape about its rotational axis and in the opposite sense to the turns of the helix.

6. The centrifuge according to claim 2, characterized in that the strips extend generally parallel to the conveyance direction of the solid material and inclined at an angle to the longitudinal bowl axis.

7. The centrifuge according to claim 1, characterized in that the adhering layer exhibits a patchy, or crossing pattern.

8. The centrifuge according to claim 1, characterized in that the adhering layer extends all the way to the solid material discharge opening.

9. The centrifuge according to claim 1, characterized in that the adhering layer includes a synthetic plastic material.

10. The centrifuge according to claim 1, characterized in that the adhering layer includes a ceramic material.

11. The centrifuge according to claim 1, characterized in that the adhering layer includes tungsten carbide.

12. The centrifuge according to claim 1, characterized in that the adhering layer includes natural and/or synthetic granular materials, such as carborundum, silicon carbide.

13. The centrifuge according to claim 1, characterized in that the adhering layer includes ceramic, mineral, organic, or metallic binders.

14. The centrifuge according to claim 1, characterized in that the adhering layer includes a synthetic binder material such as phenol formaldehyde condensate, alkyl resins.

15. The centrifuge according to claim 1, characterized in that the adhering layer is less than 0.5 mm in thickness.

16. The centrifuge of claim 1, wherein the layer is formed by spraying-on of a granular material.

17. The centrifuge of claim 16, wherein the layer is less than about 0.5 mm in thickness.

18. The centrifuge according to claim 1, characterized in that said partial areas are discontinuous.

* * * * *